US010731946B1

(12) United States Patent
Hamilton

(10) Patent No.: US 10,731,946 B1
(45) Date of Patent: Aug. 4, 2020

(54) PISTOL HOLSTER

(71) Applicant: Point Blank Enterprises, Inc., Pompano Beach, FL (US)

(72) Inventor: Benjamin Hamilton, Lillington, NC (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 27 days.

(21) Appl. No.: 16/252,600

(22) Filed: Jan. 19, 2019

(51) Int. Cl.
*F41C 33/02* (2006.01)
*F41C 33/04* (2006.01)

(52) U.S. Cl.
CPC ..... *F41C 33/0254* (2013.01); *F41C 33/0209* (2013.01); *F41C 33/041* (2013.01); *F41C 33/048* (2013.01)

(58) Field of Classification Search
CPC ..... F41C 33/0209; F41C 33/041; F41C 33/0236; F41C 33/0254; F41C 33/048; F41C 33/04; Y10S 224/911; Y10S 224/912; A45F 2200/0591
See application file for complete search history.

(56) References Cited

U.S. PATENT DOCUMENTS 3,630,420 A * 12/1971 Bianchi ..... F41C 33/0209 224/193
5,282,559 A * 2/1994 Wisser ..... F41C 33/0227 224/193
5,518,155 A * 5/1996 Gallagher ..... F41C 33/04 224/244
6,085,951 A * 7/2000 Beletsky ..... F41C 33/0227 224/242
6,769,581 B2 * 8/2004 Rogers ..... F41C 33/0227 224/193
7,735,255 B1 * 6/2010 Kincaid ..... F41C 33/0254 362/110
7,922,050 B2 * 4/2011 Beneš ..... F41C 33/0227 224/244
8,474,670 B1 * 7/2013 Gregory ..... F41C 33/0263 224/243
9,222,750 B1 * 12/2015 Keepers ..... F41C 33/0209
10,302,391 B1 * 5/2019 Akar ..... F41C 33/045
2002/0047029 A1 * 4/2002 Liao ..... F41C 33/0209 224/244

(Continued)

*Primary Examiner* — Brian D Nash
(74) *Attorney, Agent, or Firm* — Luccarelli & Musacchio LLP; Peter A. Luccarelli Jr.

(57) ABSTRACT

A holster shell is constructed with a horizontally oriented closed bottom wall, which along with opposing outward and inward facing sidewalls form a U-shaped cross section. A holster cavity is exposed along front and rear sides of the holster shell, through respective front and rear gaps that are defined between the sidewalls and the bottom wall. In some embodiments, the front gap of the holster cavity provides clearance for varying dimension, electro-optical or other sighting systems. In some embodiments, the rear gap of the holster cavity provides clearance for varying dimension laser sights and/or flashlight modules. Handgun retention features, such as trigger guard and/or ejection port conforming profiles, are defined within the holster shell. When a corresponding handgun is inserted within the holster cavity, the holster shell provides retention bias against the handgun.

20 Claims, 4 Drawing Sheets

(56) References Cited

U.S. PATENT DOCUMENTS

| | | | | |
|---|---|---|---|---|
| 2005/0127121 | A1* | 6/2005 | Wells | F41C 33/0209 224/193 |
| 2006/0011680 | A1* | 1/2006 | Cook | F41C 33/0209 224/243 |
| 2007/0175935 | A1* | 8/2007 | Clifton, Jr. | F41A 17/00 224/243 |
| 2008/0121670 | A1* | 5/2008 | Buress | F41C 33/0254 224/243 |
| 2009/0321480 | A1* | 12/2009 | Kincaid | F41C 33/0227 224/243 |
| 2013/0181020 | A1* | 7/2013 | Rogers | F41C 33/0236 224/243 |
| 2015/0247701 | A1* | 9/2015 | Faifer | F41C 33/0209 224/244 |
| 2015/0345899 | A1* | 12/2015 | Bardy | F41C 33/0236 224/243 |
| 2016/0238342 | A1* | 8/2016 | Tedder | F41C 33/0263 |
| 2016/0273878 | A1* | 9/2016 | Sereday | F41C 33/0209 |
| 2017/0089666 | A1* | 3/2017 | Considine | F41C 33/048 |
| 2017/0191794 | A1* | 7/2017 | Garibaldi | F41C 33/0236 |
| 2017/0276453 | A1* | 9/2017 | Lance | F41C 33/0263 |
| 2018/0224230 | A1* | 8/2018 | Myers | G03B 17/38 |
| 2018/0224240 | A1* | 8/2018 | Sereday | F41C 33/0254 |

* cited by examiner

PISTOL HOLSTER

TECHNICAL FIELD

The invention relates to pistol holsters. More particularly, the invention relates to holsters capable of retaining pistols having different combinations of sighting systems and/or illumination systems mounted on their frames, barrels or slides, while the holster and handgun are concealed under cover garments.

BACKGROUND

There is a growing trend among handgun users to affix myriads of frame and/or slide mounted auxiliary devices on semi-automatic pistols and revolvers. Exemplary auxiliary devices include sighting systems and illumination devices. Handgun holster manufacturers now face design challenges on how to construct holsters that can accommodate previously unknown combinations and types of auxiliary devices.

Traditionally, handguns have incorporated a bladed, mechanical front sight post and a corresponding rear sight with a sighting notch, on top surfaces of their frames and barrels. Similar sets of mechanical sights have also been incorporated on slides, frames, or barrels. Dimensions and locations of traditional mechanical sighting systems varied only slightly within any handgun model. Generally, the front sight was located at the muzzle end of the handgun and the rear sight was located near the opposite end of the slide or frame. A holster manufacturer dimensioned its holster cavity to provide sufficient clearance for passage of the mechanical front sight during insertion and draw of the handgun. The front face of the holster body was dimensioned to leave the rear sight exposed above the top edge of the holster cavity. Traditionally, the holster cavity was dimensioned to fit snugly against the lower surface of the handgun frame and trigger guard. Thus, traditional holster designers had a limited number of variations in holster cavity dimensions for any particular handgun model.

Auxiliary sighting and illumination systems are evolving rapidly. Many are of modular construction that is selectively attached to universal rails, dovetails, or mounting plates, which are formed in the handgun. Pistol owners now expect holster manufacturers to produce holsters with flexibility to accept new combinations of these auxiliary systems as they evolve, without the need to purchase an upgraded holster. In response to consumer demand, holster manufacturers need to configure holster cavities with dimensions that can accommodate different combinations of modular, auxiliary systems, while retaining the pistols securely. For example, traditional front and rear mechanical sights are now dimensioned in a largely varying height for use with sound suppressors and optical sights. Slide-mounted, electro-optical sights require additional clearance within the front area of the holster cavity. Alternatively the holster front must be cut lower to clear the sight, but with tradeoffs of less structural support for retention of the handgun and exposure of the relatively delicate electro-optical sight to externally induced blows or other damage.

Frame-mounted or trigger guard-mounted illumination systems, such as projecting lasers and/or flashlights, require reconfiguration of the rear and lower portions of the holster cavity near the lower frame surface and trigger guard. As each of the different manufactured illumination systems have varying dimensions, holster manufacturers have had to design multitudes of holster cavity dimensions for any given handgun type, in order to accommodate them. Each range of holster cavity dimensions necessitates reconfiguration of the holster shell to provide sufficient handgun retention.

While it is possible to configure traditional design holsters with relatively large holster cavities for accommodation of auxiliary sighting and/or illumination systems, such holsters require structural modification to provide sufficient handgun retention. The holster cavity and structural reinforcement modifications generally necessitate bulkier external dimensions of the holster shell. Bulkier physical dimensions are acceptable for externally visible, "open carry", holster wearers, such as military or police first responders. Many jurisdictions, by law or policy, mandate concealed lawful carry of handguns, except by first responders who are dressed in official uniforms. Increased holster bulk is not desirable for concealed carry under or within garments. In concealed carry mode, bulkier holsters disrupt drape of outer concealment garments, potentially exposing outline of underlying handgun and holster to casual observers. The unwanted exposure risks violation of legally mandated, concealed carry objectives.

SUMMARY

A handgun holster includes a holster shell that is constructed with a horizontally oriented closed bottom. The bottom, along with opposing outward and inward facing sidewalls, form a U-shaped cross section. The holster defines a cavity for retention of a handgun. The holster cavity is exposed along front and rear sides of the holster shell, in respective front and rear gaps between the sidewalls. The front gap in the exposed, front side of the holster cavity provides clearance for varying dimension, electro-optical, optical, metallic blade, or other sighting systems. The exposed rear gap in the exposed, rear side of the holster cavity provides clearance for varying dimension laser sights and/or flashlight modules. Holster retention features, such as trigger guard and/or ejection port conforming profiles, are incorporated within the holster shell. When a corresponding handgun is inserted within the holster cavity, the holster shell provides retention bias against the handgun.

Handgun holster embodiments described herein are capable of retaining securely handguns with varying combinations of auxiliary sighting and/or illumination systems, without significant increase in holster bulk. These holsters have holster cavities with exposed front and rear sides in gaps formed between their opposing sidewalls. The exposed front side provides clearance for varying dimension, electro-optical or other sighting systems. In some embodiments, the front side of the holster also provides impact-shielding protection to the sight. The exposed rear side provides a more cost efficient and space efficient holsters that will accommodate varying dimension illumination devices, such as laser sights and/or flashlight modules. In some embodiments, the rear side of the holster also provides impact-shielding protection to the illumination device.

Construction of the present holster, with front and rear gaps between the opposing sidewalls, increases manufacturing efficiency by reducing the number of holster shell configurations needed to accommodate different combinations of auxiliary sighting and illumination devices that are attached to a given handgun model. During design of holster embodiments described herein, front and/or rear portions of the holster cavity are sized to accept similarly dimensioned auxiliary devices within a defined dimensional range. The bottom wall and opposed sidewalls of the holster of the U-shaped holster are capable of flexing within the defined dimensional range of the auxiliary devices, while retaining the handgun with sufficient biasing force to prevent inadvertent separation from the holster. Similarly dimensioned groups of auxiliary sighting or illumination devices are accommodated in a common holster shell design for a specific handgun. Thus, the holster manufacturer reduces the number of different holster shell configurations needed to accommodate a range of different auxiliary devices for any specific handgun model.

The holster shell is constructed with a horizontally oriented closed bottom wall, which forms a U-shaped cross section. Outward and inward facing, respective first and second sidewalls, along with the closed bottom wall, form the U-shaped cross section, leaving respective front and rear gaps between the front and rear faces of the first and second sidewalls and the bottom wall of the holster shell. The holster cavity is exposed along the front, rear, and top sides of the holster shell. The exposed front side of the holster cavity allows passage and receipt of varying dimension sighting systems, while the exposed rear side of the cavity allows passage and receipt of varying dimension illumination systems. Holster retention features, such as trigger guard and/or ejection port conforming profiles, are formed or affixed within the holster shell. When a corresponding handgun is inserted within the holster cavity, the holster shell provides retention bias against the handgun. In some embodiments, one or more tension screws are provided for additional handgun retention bias. In some embodiments, sidewalls of the holster shell are profiled for conforming to corresponding body profile of the holster wearer, which facilitates concealment under outer garments. In some embodiments, different types of belt or other retention features are provided for attachment to the handgun wearer's garments, such as for mounting inside or outside skirt or trouser waistbands.

Exemplary handgun holster embodiments feature a U-shaped holster shell including a bottom wall and opposing first and second sidewalls. In some embodiments, the first sidewall is outwardly exposed and the second sidewall faces a wearer's body. The bottom wall has front and rear faces. Proximal ends of the first and second sidewalls are joined and bridged by the bottom wall, which completes structurally the U-shape profile of the holster shell. The respective first and second sidewalls have front and rear faces conjoined by the corresponding front and rear faces of the bottom wall, and distal ends. The holster shell has a front side with a front gap defined between the conjoined front faces of the bottom wall and the front and rear sidewalls; and a rear side having a rear gap defined between the conjoined rear faces of the bottom wall and the front and rear sidewalls. Inner surfaces of the respective bottom wall and the first and second sidewalls define a cavity for insertion of a handgun within the U-shaped holster shell between the respective distal ends of the first and second sidewalls. The first and second sidewalls are outwardly biasable relative to each other, for exerting biasing pressure on a handgun upon its insertion into the holster cavity. At least one holster retention surface is coupled to at least one of the inner surfaces of the first and second sidewalls, for biased mating engagement with a retention surface of a handgun that is inserted within the cavity. In some embodiments, the holster retention surface mates with a corresponding ejection port or cylinder of the handgun. In other embodiments, the holster retention surface is mated with a corresponding trigger guard of the handgun. In some embodiments, a selectively adjustable tension screw is affixed to the first and second sidewalls. Then, longitudinal gap between their respective sidewall inner surfaces is varied selectively with the tension screw. In some embodiments, an attachment device, such as a clip or a loop, or a paddle, or a slot is affixed to the holster shell, for attachment to a belt of a wearer.

Other exemplary embodiments include methods for manufacturing a handgun holster. In one embodiment, the method is practiced by fabricating a U-shaped, unistructural-monolithic holster shell, with opposing first and second sidewalls. Proximal ends of the first and second sidewalls are joined and bridged by a bottom wall. The bottom wall has front and rear faces. The respective first and second sidewalls have front and rear faces conjoined by the corresponding front and rear faces of the bottom wall, and distal ends. The holster shell has a front side with a front gap defined between the conjoined front faces of the bottom wall and the front and rear sidewalls; and a rear side having a rear gap defined between the conjoined rear faces of the bottom wall and the front and rear sidewalls. Inner surfaces of the respective bottom wall and the first and second sidewalls define a cavity for insertion of a handgun within the U-shaped holster shell between the respective distal ends of the first and second sidewalls. The first and second sidewalls are outwardly biasable relative to each other, for exerting biasing pressure on a handgun upon its insertion into the cavity. During formation of the unistructural-monolithic U-shaped holster shell, at least one holster retention surface is formed on least one of the inner surfaces of the first and second sidewalls, for biased mating engagement with a retention surface of a handgun that is inserted within the cavity. In some embodiments, the holster shell is fabricated by injection molding or blow molding. In other embodiments, the holster shell is fabricated by molding and shaping a planar thermoplastic sheet, wherein the handgun retention features are formed in the sheet during the molding process. In some embodiments, a selectively adjustable tension screw is affixed to the first and second sidewalls. Then, longitudinal gap between their respective sidewall inner surfaces is varied selectively with the tension screw. In some embodiments, an attachment device, such as a clip or a loop, or a paddle, or a slot is affixed to the holster shell, for attachment to a belt of a wearer.

The respective features of the exemplary embodiments that are described herein may be applied jointly or severally in any combination or sub-combination.

BRIEF DESCRIPTION OF DRAWINGS

The exemplary embodiments are further described in the following detailed description in conjunction with the accompanying drawings, in which.

To facilitate understanding, identical reference numerals have been used, where possible, to designate identical elements that are common to the figures. The figures are not drawn to scale.

DESCRIPTION OF EMBODIMENTS

Exemplary embodiments of the holster described herein are suitable for concealed carry of a handgun, including a handgun with either or both of an auxiliary sighting device or an illumination device. The holster shell is constructed with a horizontally oriented closed bottom, which along with opposing outward and inward facing sidewalls form a U-shaped cross section. In some embodiments, sidewalls of the holster shell are profiled for conforming to corresponding body profile of the holster wearer, which facilitates concealment under outer garments. The holster cavity is exposed along front and rear sides of the holster shell, along respective front and rear gaps between the sidewalls. In some embodiments, the exposed front side of the holster cavity provides clearance for varying dimension, electro-optical or other sighting systems. In some embodiments, the front side of the holster also provides impact-shielding protection to the sight. In some embodiments, the exposed rear side of the holster cavity provides clearance for varying dimension laser sights and/or flashlight modules. In some embodiments, the rear side of the holster also provides impact-shielding protection to the illumination device. Handgun-retention surface features, such as trigger guard and/or ejection port conforming profiles, are affixed within the holster shell. When a corresponding handgun is inserted within the holster cavity, the holster shell provides retention bias against the handgun, by flexing the sidewalls away from each other. The horizontally folded, U-shape profile of the bottom and sidewalls of the holster shell are capable of retaining handguns with varying combinations of auxiliary sighting and/or illumination systems securely, without significant increase in holster bulk. In some embodiments, tension screws are provided between the sidewalls, for additional handgun retention bias. In some embodiments, different types of belt or other retention features are provided for attachment to the handgun wearer's garments, such as for mounting inside or outside skirt or trouser waistbands. In some embodiments, the belt retention features are modular and selectively replaceable, for adaptation of the holster to pocket, inside waistband, and outside waistband carry modes.

Figure 2:
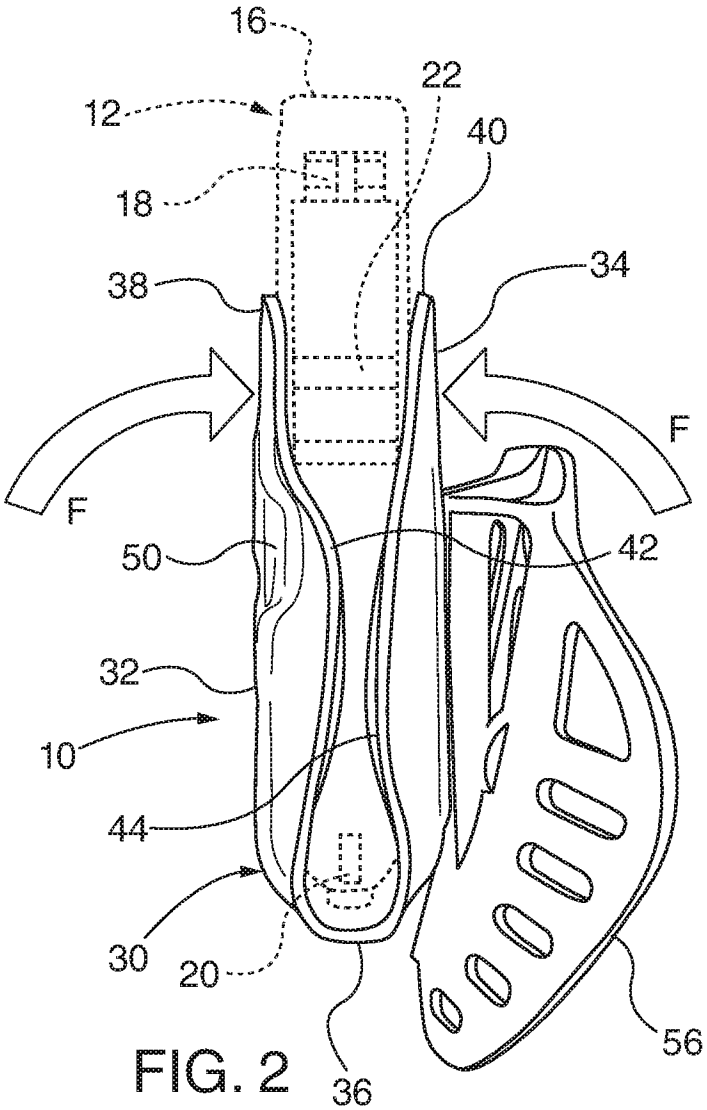
FIG. 2 is a front elevational view of the holster of FIG. 1.
Figure 1:
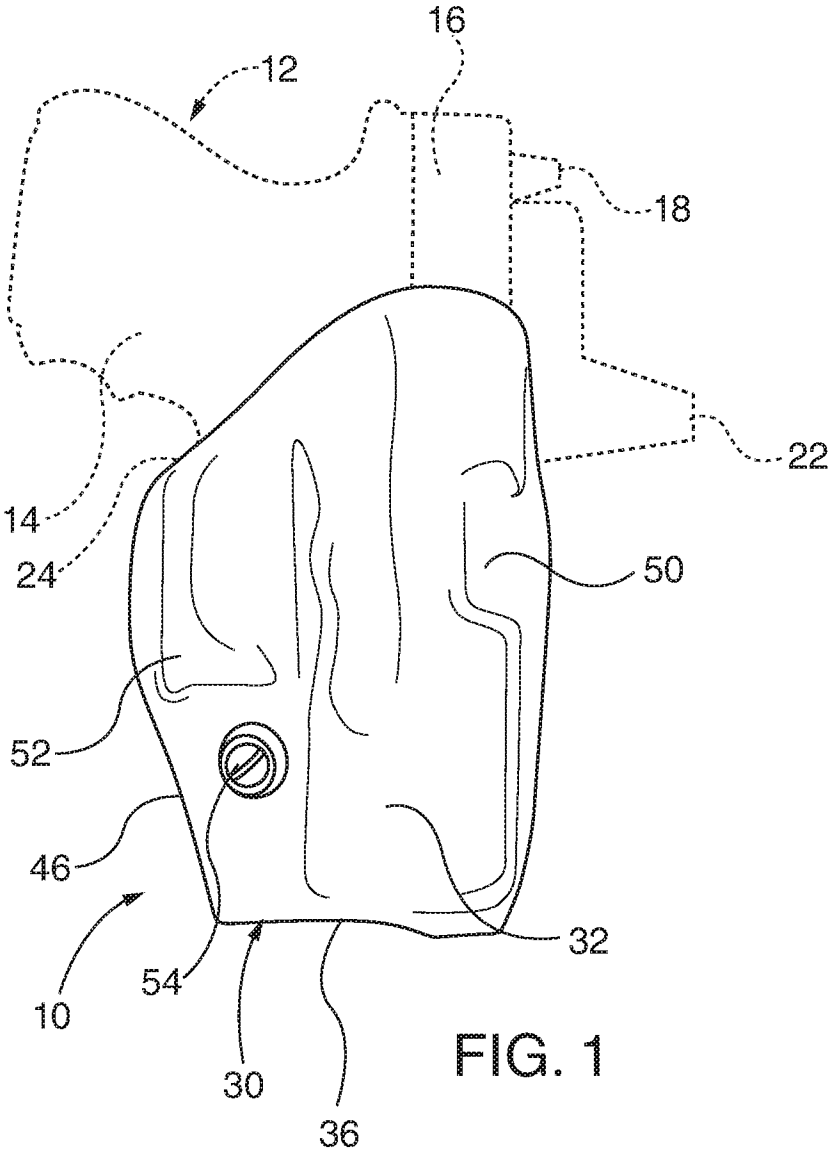
FIG. 1 is an outer elevational view of a first side of a holster constructed in accordance with an embodiment described herein, which retains a handgun with a slide-mounted electro-optical sighting device.
Figure 3:
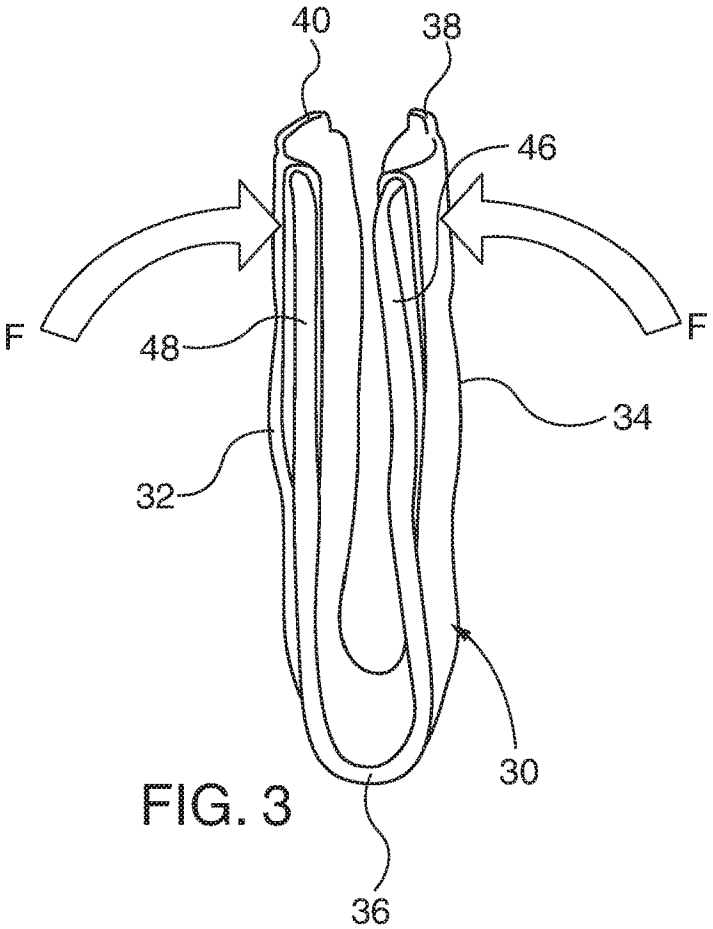
FIG. 3 is a rear elevational view of the holster of FIG. 2, without a handgun inserted therein.

FIGS. 1-3 show an exemplary embodiment of a handgun holster 10, for retention of a semi-automatic handgun 12 of known construction. The handgun 12 is not part of the holster 10 and thus is shown in phantom lines. The handgun 12 has a frame 14 and a slide 16. Slide-mounted, extended-height, mechanical rear 18 and front 20 sights are configured for compatible back-up use with a slide-mounted electro-optical sight 22. The front sight 20 and the electro-optical sight 22 extend a greater vertical distance from a top face of the slide 16 than traditional-height mechanical sights. While FIGS. 1-3 show the holster 10, configured for retention of the semi-automatic pistol 12, in other embodiments the holster is configured for retention of a revolver, with or without electro-optical sights and/or frame-mounted illumination devices.

The holster 10 is constructed with a U-shaped holster shell 30 that includes opposing, mutually spaced, corresponding first 32 (outwardly facing on a holster wearer) and second 34 (inwardly facing) sidewalls. The respective sidewalls 32, 34 have proximal ends joined and bridged by a bottom wall 36, and respective corresponding distal ends 38, 40. The first sidewall 32 terminates laterally in a front face 42 and in a rear face 46, which are mutually spaced from a corresponding front face 44 and rear face 48 of the second sidewall 34. A holster cavity is defined between inner surfaces of the respective first 32 and second 34 sidewalls of the U-shaped holster shell 30. The holster cavity is exposed at the top of the holster shell 30, defined by the distal ends 38, 40 of the respective sidewalls 32, 34. The holster cavity is exposed at the front side of the holster shell 30, defined by the front faces 42, 44 of the respective sidewalls 32, 34, and is exposed at the rear side of the holster shell, defined by the rear faces 46, 48 of the sidewalls.

In the embodiment of FIGS. 1-3, exposed front side of the holster cavity provides clearance for insertion and withdrawal of the handgun 12 and its slide-mounted front sight 20 and a portion of the electro-optical sight 22. In some embodiments, front faces 42 and 44 of the sidewalls extend further from the front side of the holster, providing impact-shielding protection to the sights 18, 20 and 22. The U-shaped cross section of the holster body 30, with its horizontally oriented bottom wall 36 supports and retains the handgun 12 with the sidewalls 32, 34 despite the front and rear gaps established between the sidewalls. As previously described, the gap defined at the front of the holster shell 30, between the front faces 42 and 44 of the sidewalls and the bottom wall 36 provides clearance for any type of slide- or barrel-mounted accessories, such as the mechanical sights 18, 20 and the electro-optical sight 22. As will be described in detail with respect to FIG. 9, the gap defined at the rear of the holster shell 70 and related sidewalls profiles provide clearance for any type of frame-mounted accessories, such as illumination devices.

The first 32 and second 34 sidewalls are outwardly biasable relative to each other, as shown by the force arrows F, for exerting reactionary biasing pressure on a handgun upon its insertion into the holster cavity. One or more handgun holster-retention surfaces are coupled to at least one of the inner surfaces of the first 32 and/or second 34 sidewalls, for corresponding mating engagement with a retention surface of a handgun that is inserted within the cavity. In FIGS. 1 and 2, his holster shell 30 has two holster retention surfaces. An ejection-port retention surface 50 of the holster shell 30 is an inwardly facing, convex projection for mating engagement within a corresponding ejection port depression formed within the handgun slide 16, when the handgun is inserted into the cavity of the holster shell 30. A trigger-guard retention surface 52 of the holster shell 30 comprises both an inwardly facing, convex projection, for mating engagement within the inner periphery of a corresponding depression of a trigger guard of the frame 14, (i.e., the open space within the trigger guard that protects against inadvertent trigger manipulation), and a concave depression that mates with the outer periphery of the trigger guard, when the handgun is inserted into the cavity of the holster shell. In revolver holster embodiments, holster retention surfaces formed within the holster shell mate with the revolver cylinder or the trigger guard. Biasing force F, generated by flexure of the holster shell 30, sidewalls 32, 34 and the connecting bottom wall 36, in conjunction with the ejection-port retention surface 50 and the trigger-guard retention surface 52 retain the handgun 12 within the cavity of the holster shell 30. Optional retention screw 54 bridges and selectively varies longitudinal gap between the first 32 and second 34 sidewalls, for selectively varying biasing tension on the handgun 12.

Figure 4:
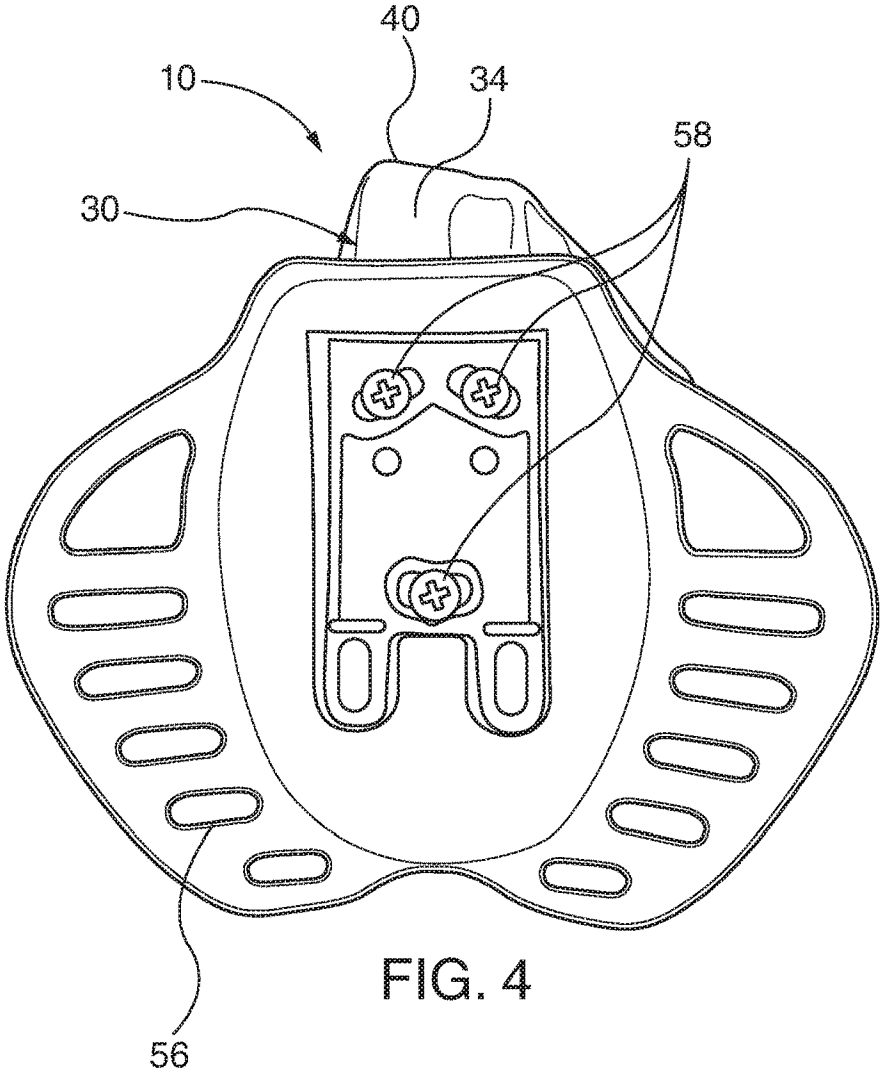
FIG. 4 is an inner elevational view of a second side of the holster of FIG. 2, without a handgun inserted therein, including a retention paddle, for affixation of the holster outside of a waistband or belt of a holster wearer.
Figure 5:
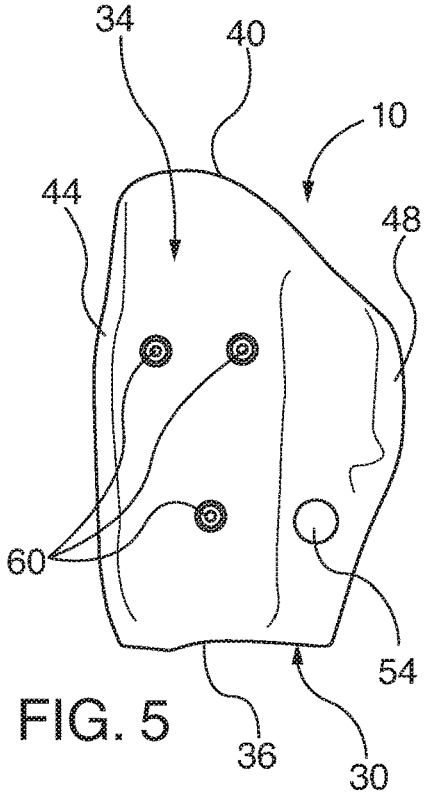
FIG. 5 is an inner elevational view of the second side of the holster of FIG. 4, without the retention paddle.

Embodiments of the holster 10 incorporate devices for attachment to waistbands and belts of users. FIGS. 2, 4 and 5 show a paddle 56, attached to the holster shell 30 by screws 54 that are received in corresponding mounting nuts 60, affixed to the second (inner) sidewall 34. In some embodiments, the screws are coupled to the inner sidewall 34 while the nuts are coupled to the paddle 56. The paddle 56 is inserted between the wearer and the waistband of the wearer's skirt or trouser garment, while the remainder of the holster 10 is oriented outside the waistband. In some embodiments, the paddle is affixed to the first (outer) sidewall of the holster shell, for inside-the-waistband carry of the handgun.

Figure 6:
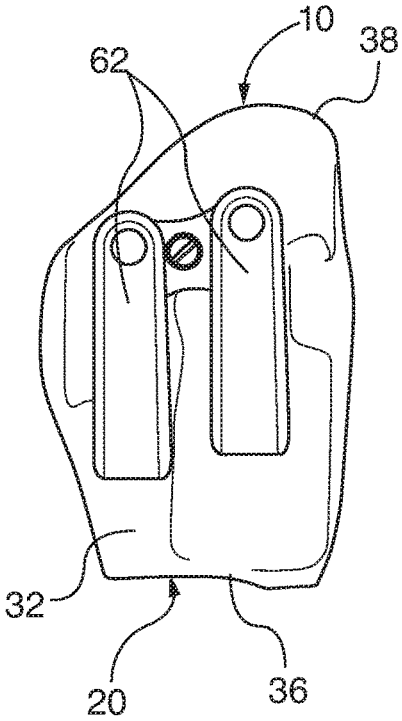
FIG. 6 is a top perspective view a holster constructed in accordance with an embodiment described herein, which includes belt loops for affixation of the holster inside a waistband of a holster wearer.
Figure 7:
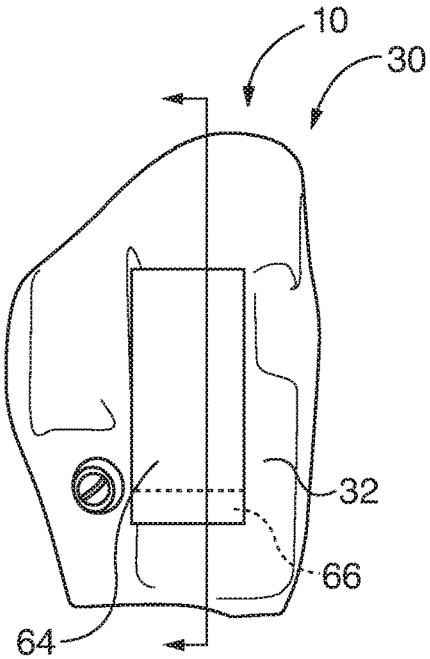
FIG. 7 is an outer elevational view similar to FIG. 1, of an alternative embodiment of a holster, which includes a retention clip for affixation of the holster inside a waistband of a holster wearer.
Figure 8:
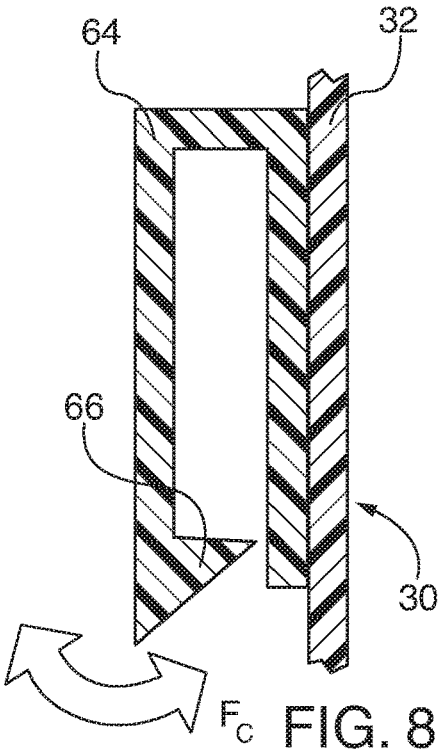
FIG. 8 is an elevational cross sectional view of the holster of FIG. 7, taken along 8-8 thereof.

In the embodiment of FIG. 6, adapted for inside-the-waistband carry, flexible snap loops 62 are coupled to the first (outer) sidewall 32 of the holster 10. The bottom wall 36 of the holster 10 is inserted into a wearer's waistband, while the snap loops 62 are affixed externally to the wearer's belt. In some embodiments, solid loops are substituted for the snap loops. Holster 10 in the embodiment of FIGS. 7 and 8, is also configured for inside-the-waistband carry. A biasable clip 64 is coupled to the first sidewall 32. The clip is flexed outwardly away from the first sidewall 32 (see force arrow $F_C$) and the holster shell 30 is inserted into the wearer's waistband. When the clip flexes back to its at rest state the clip hook 66 presses against the garment waistband. The wearer's belt, if any, is captured within the clip 64 above the hook 66. In some embodiments, the loops or clips are coupled to the inner sidewall of the holster shell, for outside-the-waistband carry. In some embodiments, one or more slots are formed in the holster shell 30, for receipt of a belt or strap.

Some holster embodiments are intended for carry in a garment pocket or in a bag for off-body carry. In such embodiments, the bare holster shell 30 does not incorporate any form of waistband or other retention device.

Figure 9:
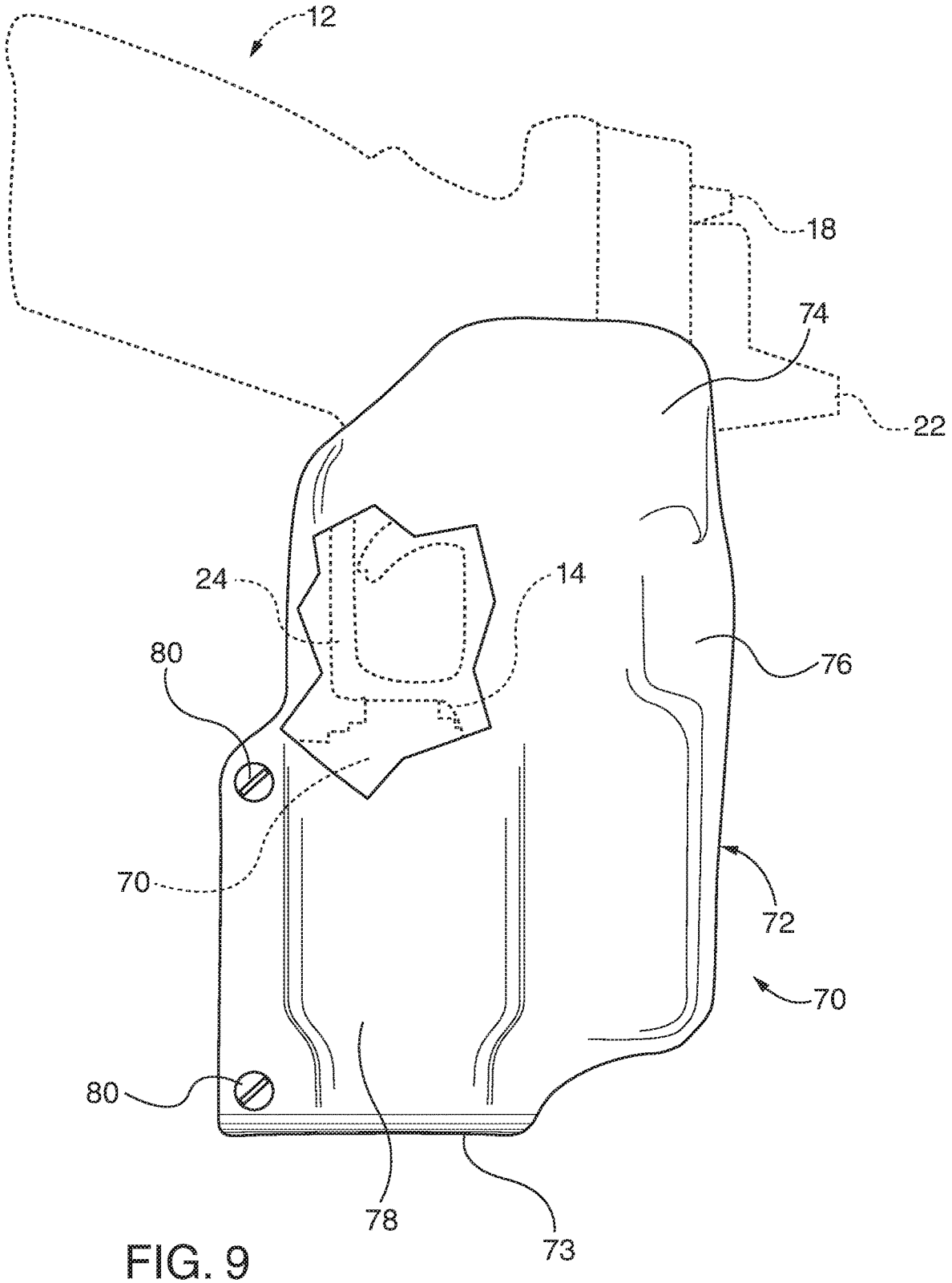
FIG. 9 is an outer elevational view similar to FIG. 1, of an alternative embodiment of a holster, which also retains a frame-mounted illumination device of a handgun.

Holster embodiments described herein also accommodate handguns with different illumination devices, such as lasers or flashlights, and other devices mounted on its lower frame and/or trigger guard. If the frame- or trigger guard-mounted device is relatively comparable in size to the handgun's trigger guard, it may fit within the cavity confines of the holster shell 30, shown in the various FIGS. 1-8. If the device is relatively large, the holster 70 of FIG. 9 provides extra cavity volume to accommodate them. The holster shell 72 incorporates the general U-shaped profile as the holster shell 30 of FIG. 1. The holster shell 72 has a bottom wall 73, and a first (outer) sidewall 74, and the ejection-port retention surface 76. The first sidewall 74 incorporates a generally cylindrical profile portion 78, below the trigger guard-receiving portion of the holster cavity, of sufficiently large profile and volume to receive an illumination device 82 that is affixed to the lower frame 14 and/or the trigger guard 24 of handgun 12. In some embodiments, the second or inner sidewall (not shown) of the holster shell 72 also has a cylindrical profile portion matching the profile portion 78 of the first sidewall 74. The handgun 12 and illumination device 82 are shown in phantom lines. Two retention screws 80 are affixed to the holster shell 72; they have similar structure, operation and function as the retention screw 54 of FIG. 1.

Embodiments of the holsters 10 and 70 of FIGS. 1, 2 and 9 comprise unistructural-monolithic holster shells 30 and 72, with formed-in-place, ejection-port retention surfaces 50, 76, and/or trigger-guard retention surfaces 52. In some embodiments, the holster shells of the holsters 10 and 70 are injection molded or blow molded. In other embodiments, the unistructural-monolithic holster shells 30 and 72 comprise folded and shaped planar thermoplastic sheets. By way of example, the holster shell 30 is fabricated by heating a planar sheet of thermoplastic to a pliable material state. The planar sheet is folded to create the bottom wall 36 and the first and second sidewalls 32, 34 of the U-shaped profile holster shell 30. While the sheet is pliable, the ejection-port 50 and the trigger-guard 52 retention surfaces are also formed, along with any edge curling or profiling of the respective terminating front faces 42, 44 and terminating rear faces 46, 48 of the respective first 32 and second 34 sidewalls. While the pliable sheet is worked to form the holster shell 30, dimensions of gaps between the opposing first 32 and second 34 sidewalls are established, for receipt and passage of various desired optical or illuminations devices that might be attached to the associated handgun model.

Fabrication and construction of monolithic holster shell embodiments, with front and rear gaps between the opposing sidewalls, increases manufacturing efficiency, by reducing the number of holster shell configurations needed to accommodate different combinations of auxiliary sighting and illumination devices that are attached to a given handgun model. During design of holster embodiments described herein, front and/or rear portions of the holster cavity are sized to accept similarly dimensioned auxiliary devices within a defined dimensional range. For example, in some embodiments, such as the holster 70 of FIG. 9, dimensions of the generally cylindrical profile portion 78 are varied in a family different holster shells to accommodate a variety of similarly sized flashlights or illumination devices, while the central portion of the shell is dimensioned to accept a particular handgun model. In any holster 70 of such a holster family, the bottom wall 73 and at least the sidewall 74 (but more likely both sidewalls) are capable of flexing within the defined dimensional range of the auxiliary devices for that particular holster family member, while retaining the handgun with sufficient biasing force to prevent inadvertent separation from the holster. Clusters of similarly dimensioned, auxiliary sighting and illumination devices are accommodated in a common holster shell design for a specific handgun. Thus, the holster manufacturer reduces the number of different holster shell configurations needed to accommodate a larger range of different auxiliary devices for any specific handgun model.

While some embodiments incorporate unistructural-monolithic holster shells, other embodiments comprise fabricated individual components. By way of example, in some other embodiments, the bottom wall of the holster shell comprises a spine or keel-like component, upon which are coupled separate first and second sidewalls in rib-like fashion. In some embodiments, the ejection-port or trigger-guard retention surfaces are incorporated in separate fabricated components that are coupled to the holster shell.

Although various embodiments that incorporate the invention have been shown and described in detail herein, others can readily devise many other varied embodiments that still incorporate the claimed invention. The invention is not limited in its application to the exemplary embodiment details of construction and the arrangement of components set forth in the description or illustrated in the drawings. The invention is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted", "connected", "supported", and "coupled" and variations thereof are to be interpreted broadly; they encompass direct and indirect mountings, connections, supports, and couplings. Further, "connected" and "coupled" are not restricted to physical, mechanical connections or couplings.

What is claimed is:

1. A handgun holster comprising: a U-shaped holster shell including: a flexible bottom wall having front and rear faces; opposing, mutually spaced, first and second sidewalls, respectively having: proximal ends joined and bridged by the bottom wall, front and rear faces conjoined by corresponding front and rear faces of the bottom wall, and distal ends; a front side having a front gap defined between the conjoined front faces of the bottom wall and the front and rear sidewalls; a rear side having a rear gap defined between the conjoined rear faces of the bottom wall and the front and rear sidewalls; inner surfaces of the respective bottom wall and the first and second sidewalls defining a cavity for insertion of a handgun within the U-shaped holster shell between the respective distal ends of the first and second sidewalls; the respective distal ends of the first and second sidewalls inwardly biasable relative to each other for exerting biasing pressure on a handgun upon its insertion into the cavity; and at least one holster retention surface coupled to at least one of the inner surfaces of the first and second sidewalls, for biased mating engagement with a corresponding retention surface of a handgun that is inserted within the cavity.

2. The holster of claim 1, further comprising a selectively adjustable tension screw coupled to the first and second sidewalls, for selectively varying longitudinal gap between their respective inner surfaces.

3. The holster of claim 1, further comprising a clip or a loop, or a paddle, or a slot coupled to the holster shell, for attachment to a garment waistband or a belt of a wearer thereof.

4. The holster of claim 1, further comprising the front gap between the opposing front faces of the first and second sidewalls and the bottom wall sized for allowing passage of an optical sight mounted on a handgun frame, barrel or slide therebetween.

5. The holster of claim 1, further comprising the rear gap between the opposing rear faces of the first and second sidewalls and the bottom wall sized for allowing passage of an illumination device mounted on a handgun frame therebetween.

6. The holster of claim 1, the holster retention surface further comprising a convex projection for mating engagement within a corresponding depression formed within a handgun that is inserted within the cavity.

7. The holster of claim 6, further comprising the convex projection of the holster retention surface engaging within an ejection port or a trigger guard of a handgun that is inserted within the cavity.

8. The holster of claim 1, the holster retention surface further comprising a concave depression for mating engagement within a corresponding projection formed on a handgun that is inserted within the cavity.

9. A handgun holster comprising: a U-shaped, unistructural-monolithic holster shell including: a flexible bottom wall having front and rear faces; opposing, mutually spaced, first and second sidewalls, respectively having: proximal ends joined and bridged by the bottom wall, front and rear faces conjoined by corresponding front and rear faces of the bottom wall, and distal ends; a front side having a front gap defined between the conjoined front faces of the bottom wall and the front and rear sidewalls; a rear side having a rear gap defined between the conjoined rear faces of the bottom wall and the front and rear sidewalls; inner surfaces of the respective bottom wall and the first and second sidewalls defining a cavity for insertion of a handgun within the U-shaped holster shell between the respective distal ends of the first and second sidewalls; the respective distal ends of the first and second sidewalls inwardly biasable relative to each other for exerting biasing pressure on a handgun upon its insertion into the cavity; and at least one holster retention surface coupled to at least one of the inner surfaces of the first and second sidewalls, for biased mating engagement with a corresponding retention surface of a handgun that is inserted within the cavity.

10. The holster of claim 9, the holster retention surface further comprising an integrally formed projection of the holster shell, for mating engagement within an ejection port or a trigger guard of a handgun that is inserted within the cavity.

11. The holster of claim 9, further comprising a clip or a loop, or a paddle, or a slot coupled to the holster shell, for attachment to a garment waistband or a belt of a wearer thereof.

12. The holster of claim 9, further comprising the front gap between the opposing front faces of the first and second sidewalls and the bottom wall sized for allowing passage of an optical sight mounted on a handgun frame, barrel or slide therebetween.

13. The holster of claim 9, further comprising the rear gap between the opposing rear faces of the first and second sidewalls and the bottom wall sized for allowing passage of an illumination device mounted on a handgun frame there between.

14. The holster of claim 9, further comprising a selectively adjustable tension screw coupled to the first and second sidewalls, for selectively varying longitudinal gap between their respective inner surfaces.

15. A method for manufacturing a handgun holster, comprising: fabricating a U-shaped, unistructural-monolithic holster shell including: a flexible bottom wall having front and rear faces; opposing, mutually spaced, first and second sidewalls, respectively having: proximal ends joined and bridged by the bottom wall, front and rear faces conjoined by corresponding front and rear faces of the bottom wall, and distal ends; a front side having a front gap defined between the conjoined front faces of the bottom wall and the front and rear sidewalls; a rear side having a rear gap defined between the conjoined rear faces of the bottom wall and the front and rear sidewalls; inner surfaces of the respective bottom wall and the first and second sidewalls defining a cavity for insertion of a handgun within the U-shaped holster shell between the respective distal ends of the first and second sidewalls; with the respective distal ends of the first and second sidewalls inwardly biasable relative to each other for exerting biasing pressure on a handgun upon its insertion into the cavity; and at least one holster retention surface formed on least one of the inner surfaces of the first and second sidewalls, for biased mating engagement with a retention surface of a handgun that is inserted within the cavity.

16. The method of claim 15, further comprising coupling a clip or a loop, or a paddle, or a slot to the holster shell, for attachment to a garment waistband or a belt of a wearer thereof.

17. The method of claim 15, further comprising sizing the front gap between the opposing front faces of the first and second sidewalls and the bottom wall, for allowing passage of an optical sight mounted on a handgun frame, barrel or slide there between.

18. The method of claim 15, further comprising sizing the rear gap between the opposing rear faces of the first and second sidewalls and the bottom wall, for allowing passage of an illumination device mounted on a handgun frame therebetween.

19. The method of claim 15, further comprising injection molding or blow molding the holster shell.

20. The method of claim 15, further comprising folding and shaping a planar thermoplastic sheet to form the holster shell.

* * * * *